US011649577B2

(12) United States Patent
Kim et al.

(10) Patent No.: US 11,649,577 B2
(45) Date of Patent: May 16, 2023

(54) WASHING MACHINE AND MANUFACTURING METHOD THEREOF

(71) Applicant: LG ELECTRONICS INC., Seoul (KR)

(72) Inventors: Sunghoon Kim, Gyeongsangnam-do (KR); Hyun Seung Lee, Busan (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 16/906,089

(22) Filed: Jun. 19, 2020

(65) Prior Publication Data

US 2020/0407905 A1 Dec. 31, 2020

(30) Foreign Application Priority Data

Jun. 27, 2019 (KR) ..... 10-2019-0077240

(51) Int. Cl.

| | |
|---|---|
| ***D06F 37/04*** | (2006.01) |
| ***D06F 37/22*** | (2006.01) |
| ***D06F 37/30*** | (2020.01) |
| ***D06F 23/02*** | (2006.01) |
| ***B21D 22/02*** | (2006.01) |

(52) U.S. Cl.

CPC ..... *D06F 37/04* (2013.01); *B21D 22/02* (2013.01); *D06F 23/02* (2013.01); *D06F 37/22* (2013.01); *D06F 37/30* (2013.01)

(58) Field of Classification Search

CPC ..... D06F 37/04; D06F 37/20; D06F 37/22; D06F 37/30

See application file for complete search history.

(56) References Cited

U.S. PATENT DOCUMENTS

| | | | | |
|---|---|---|---|---|
| 8,650,918 | B2 * | 2/2014 | McMaster | D06F 37/12 68/140 |
| 2005/0229651 | A1 * | 10/2005 | Ahn | D06F 37/04 68/142 |
| 2005/0252252 | A1 * | 11/2005 | Lee | D06F 37/04 68/139 |
| 2008/0006065 | A1 * | 1/2008 | Fumagalli | D06F 37/04 68/235 R |
| 2009/0133447 | A1 * | 5/2009 | Yoon | D06F 37/06 68/23.1 |
| 2020/0072549 | A1 * | 3/2020 | Welch | D06F 58/00 |

FOREIGN PATENT DOCUMENTS

| | | |
|---|---|---|
| KR | 10-0598000 | 7/2006 |
| KR | 10-1054408 | 8/2011 |

* cited by examiner

*Primary Examiner* — Joseph L. Perrin
(74) *Attorney, Agent, or Firm* — Fish & Richardson P.C.

(57) ABSTRACT

Provided are a washing machine that can be manufactured in a large capacity without deterioration in function, and a manufacturing method thereof. A washing machine includes a drum, a drum back, and a spider. The drum back includes a coupling portion formed to protrude in a front direction of the drum at a portion of the drum back to which the spider is coupled so as to correspond to a shape of the spider, a first forming portion formed to be recessed in a back direction of the drum at a portion of the drum back to which the spider is not coupled, and a reinforcement portion formed to additionally protrude in the front direction of the drum at a portion of the coupling portion that is adjacent to the first forming portions.

12 Claims, 9 Drawing Sheets

WASHING MACHINE AND MANUFACTURING METHOD THEREOF

CROSS-REFERENCE TO RELATED APPLICATION

This present application claims the benefit of priority to Korean Patent Application No. 10-2019-0077240, entitled "WASHING MACHINE AND MANUFACTURING METHOD THEREOF," filed on Jun. 27, 2019, the entire disclosure of which is incorporated herein by reference.

TECHNICAL FIELD

The present disclosure relates to a washing machine that can be manufactured in a large capacity without deterioration in function, and a manufacturing method thereof.

BACKGROUND

In general, a washing machine is a machine that washes laundry by using an emulsifying effect of detergent, a frictional force of a water stream made by rotation of a washing blade, and an impact applied by the washing blade. Such a washing machine mainly uses an electric motor as a main power source, and as the washing, rinsing, and dehydration processes are performed using the action of detergent and water, contaminants in clothing are separated from the clothing.

Meanwhile, washing machines are divided into a cylinder type, an agitator type, and a pulsator type depending on the washing method. Among them, the cylinder-type washing machine includes a drum rotatably disposed within a tub and performs the washing process by putting water and detergent into the drum having laundry therein.

The capacity of such a cylinder-type washing machine is determined depending on the internal volume of the drum receiving laundry therein. Users tend to prefer a washing machine with a larger capacity, because they want to be able to easily wash bulky laundry such as bedclothes at home too.

However, when manufacturing such a large-capacity washing machine, the main parts thereof, such as the drum, are increased in size, and as such, there are factors to be considered in order to prevent functional deterioration of the washing machine from occurring.

For example, when a washing machine with a relatively large capacity is manufactured, defects such as cracks or creases can occur in a drum back which is coupled to a back surface portion of the drum.

Accordingly, there is a need to perform an appropriate process for reinforcement such that defects such as crack or creases are prevented from occurring in the process of manufacturing the drum back.

Here, there is a need to maintain the capacity of the drum to be relatively large through the shape of the drum back and to perform reinforcement against defects, such that a relatively large capacity of the washing machine is achieved.

In addition, an excellent washing performance for the laundry in the drum must be secured even when a relatively large-sized drum back is applied to the large-capacity washing machine.

In this regard, Korean Patent Registration no. 10-1054408 (hereinafter referred to as "related art 1") discloses a structure of a drum of a washing machine.

Specifically, a forming portion having a drum expansion space and a bead formed in a front surface of the forming portion are disclosed in related art 1.

In the washing machine of related art 1, the forming portion is formed in a back surface of the drum in order to maximize the capacity of washing machine, and the bead is formed for reinforcing the forming portion. However, no reinforcement other than the reinforcement for the forming portion is considered in related art 1. Accordingly, in related art 1, there may be a part in the washing machine where defects can occur in the manufacturing process of the washing machine.

In addition, Korean Patent Registration no. 10-0598000 (hereinafter, referred to as "related art 2") discloses a drum back of a cylinder-type washing machine.

Specifically, related art 2 discloses a feature of a first forming portion which protrudes forward in a portion thereof that faces a spider and a feature of a second forming portion formed in the first forming portion to be recessed backward.

However, the drum back of related art 2 is formed in such a shape that the first forming portion protrudes forward and only a portion of the first forming portion is recessed backward. Accordingly, the portion that is recessed backward in the first forming portion is relatively small, and thus there is a limit in terms of the capacity of the washing machine.

In addition, the second forming portion is recessed backward and is thus ineffective in physically contacting the laundry in the drum. Accordingly, there is a limit in improving washing performance of the washing machine.

As described above, existing large-capacity washing machines have several shortcomings, and the shortcomings should be appropriately resolved.

SUMMARY

The present disclosure is directed to addressing shortcomings associated with existing washing machines.

Specifically, an aspect of the present disclosure is directed to making appropriate reinforcement against defects that can occur in the process of manufacturing a drum back of a washing machine, such that the drum back of the washing machine is manufactured in a relatively large size.

Another aspect of the present disclosure is directed to manufacturing a drum back of a washing machine in a shape that enables reinforcement against defects and secures a relatively large capacity of a drum, so as to secure a relatively large capacity of a washing machine.

Yet another aspect of the present disclosure is directed to securing a certain level of washing performance in the drum to which a relatively large-sized drum back is applied, such that no functional deterioration occurs in a large-capacity washing machine.

Aspects of the present disclosure are not limited to the above-mentioned aspects, and other technical aspects not mentioned above will be clearly understood by those skilled in the art from the following description.

A washing machine and a manufacturing method thereof according to an aspect of the present disclosure are characterized by reinforcing portions of the washing machine that become vulnerable to defects in the process of forming a protruding portion and a recessed portion while a drum back is manufactured. Specifically, in the drum back, a coupling portion may be formed to protrude in a front direction of a drum, a first forming portion may be formed to be recessed in a back direction of the drum, and a reinforcement portion may be formed in a portion of the coupling portion that is adjacent to the first forming portion.

In addition, the washing machine and the manufacturing method thereof according to an aspect of the present disclosure are characterized in that even when the vulnerable portions are reinforced, the portion that is recessed in the back direction of the drum in the process of manufacturing the drum back may be maintained. Specifically, in the drum back, the first forming portion which is recessed in the back direction of the drum may be formed, and the reinforcement portion may be formed in a portion of the coupling portion that is adjacent to the first forming portion.

In addition, the washing machine and the manufacturing method thereof according to an aspect of the present disclosure are characterized in that friction between laundry in the drum and portions of the drum back that protrude in the front direction of the drum may increase. Specifically, the coupling portion may protrude in the front direction of the drum, and the reinforcement portion may additionally protrude from the coupling portion.

Furthermore, the washing machine and the manufacturing method thereof according to an aspect of the present disclosure are characterized in that the coupling portion may include a first surface formed to be inclined and a second surface extending from the first surface to be flush with a circumferential surface of the drum back, and the reinforcement portion may be formed on the second surface.

In addition, the washing machine and the manufacturing method thereof according to an aspect of the present disclosure are characterized in that a second forming portion may be formed in the first surface to be recessed in the back direction of the drum.

Furthermore, the washing machine and the manufacturing method thereof according to an aspect of the present disclosure are characterized in that the reinforcement portion may be formed between every two adjacent first forming portions from among a plurality of first forming portions.

In addition, the washing machine and the manufacturing method thereof according to an aspect of the present disclosure are characterized in that the reinforcement portion may be formed in such a shape that a cross section of the reinforcement portion includes an arc.

Furthermore, the washing machine and the manufacturing method thereof according to an aspect of the present disclosure are characterized in that the reinforcement portion may be formed in such a shape that a plane of the reinforcement portion becomes increasingly wider towards a circumferential surface of the drum back.

In addition, the washing machine and the manufacturing method thereof according to an aspect of the present disclosure are characterized in that the drum back may be formed as a one-piece body by changing a shape of a base sheet having a plate shape.

Furthermore, the washing machine and the manufacturing method thereof according to an aspect of the present disclosure are characterized in that the drum back may be formed by pressing the base sheet through a mold.

In addition, the washing machine and the manufacturing method thereof according to an aspect of the present disclosure are characterized in that the drum back may be formed by pressing both surfaces of the base sheet simultaneously.

Technical solutions of the present disclosure are not limited to the above-mentioned technical solutions, and other technical solutions not mentioned above will be clearly understood by those skilled in the art from the following description.

Hereinafter, the effects of the washing machine and the manufacturing method thereof according to the present disclosure will be described.

According to at least one of the embodiments of the present disclosure, since the coupling portion protrudes in the front direction of the drum, and the reinforcement portion is formed in a portion of the coupling portion that is adjacent to the first forming portion recessed in the back direction of the drum, appropriate reinforcement may be made for defects that can occur when the drum back of the washing machine is manufactured in a large size.

In addition, according to at least one of the embodiments of the present disclosure, since the first forming portion is formed to be recessed in the back direction of the drum, and the reinforcement portion is formed in a portion of the coupling portion that is adjacent to the first forming portion, the reinforcement against defects may be appropriately made, and at the same time, the drum back may be manufactured in a shape capable of securing a relatively large capacity of the drum.

In addition, according to at least one of the embodiments of the present disclosure, since the coupling portion protrudes in the front direction of the drum, and the reinforcement portion additionally protrudes from the coupling portion, a certain level of washing performance in the drum to which a relatively large-sized drum back is coupled may be secured.

In addition, according to at least one of the embodiments of the present disclosure, since the coupling portion includes a first surface formed to be inclined and a second surface extending from the first surface to be flush with a circumferential surface of the drum back, and the reinforcement portion is formed on the second surface, it may be possible to appropriately reinforce a vulnerable portion of the drum back, which is neither protruded nor recessed in the process of molding the drum back and is thus affected by forces in both directions.

Furthermore, according to at least one of the embodiments of the present disclosure, since the second forming portion is formed in the first surface to be recessed in the back direction of the drum, a relatively large capacity of the drum may be secured.

In addition, according to at least one of the embodiments of the present disclosure, since the reinforcement portion is formed between every two adjacent first forming portions from among a plurality of first forming portions, the reinforcement may be uniformly made on the entire plane of the drum back.

Furthermore, according to at least one of the embodiments of the present disclosure, since the reinforcement portion is formed in such a shape that the cross section of the reinforcement portion includes an arc, even when the cross section of the reinforcement portion is relatively large, a certain degree of rigidity may be secured.

In addition, according to at least one of the embodiments of the present disclosure, since the reinforcement portion is formed in such a shape that the plane of the reinforcement portion becomes increasingly wider towards the circumferential surface of the drum back, the reinforcement effect at a portion of the circumferential surface of the drum back may be further improved.

In addition, according to at least one of the embodiments of the present disclosure, since the drum back is formed as a one-piece body by changing the shape of the base sheet having a plate shape, there is no separately joined portion in the drum back, and thus a portion vulnerable to structural deformation may be minimized.

Furthermore, according to at least one of the embodiments of the present disclosure, since the drum back is formed by pressing the base sheet through the mold, a large quantity of the drum backs may be molded in the same size.

In addition, according to at least one of the embodiments of the present disclosure, since the drum back is formed by pressing both surfaces of the base sheet simultaneously, the molding process may be relatively simple, and the defects that can be caused by a multi-stage compression molding process may be minimized.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
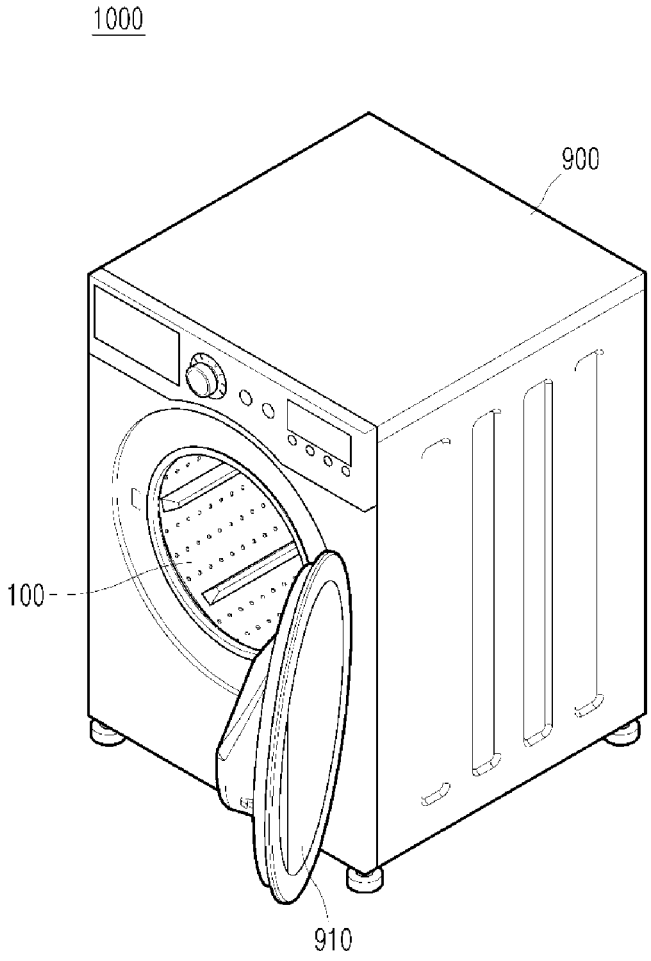
FIG. 1 is an exemplary perspective view of a washing machine according to an embodiment of the present disclosure.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Hereinafter, preferable exemplary embodiments of the present disclosure will be described in detail referring to the attached drawings. In the following description, known functions or features will be omitted in order to clarify the gist of the present disclosure.

Figure 2:
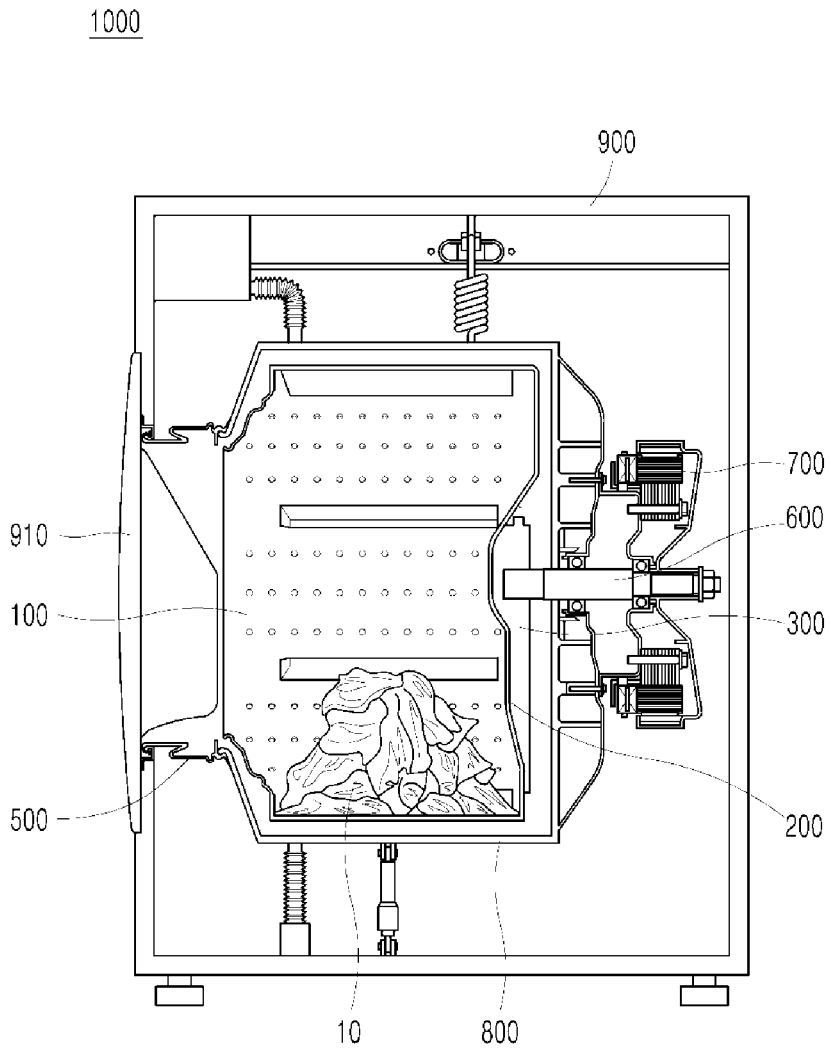
FIG. 2 is an exemplary cross-sectional view of a washing machine according to an embodiment of the present disclosure.
Figure 3:
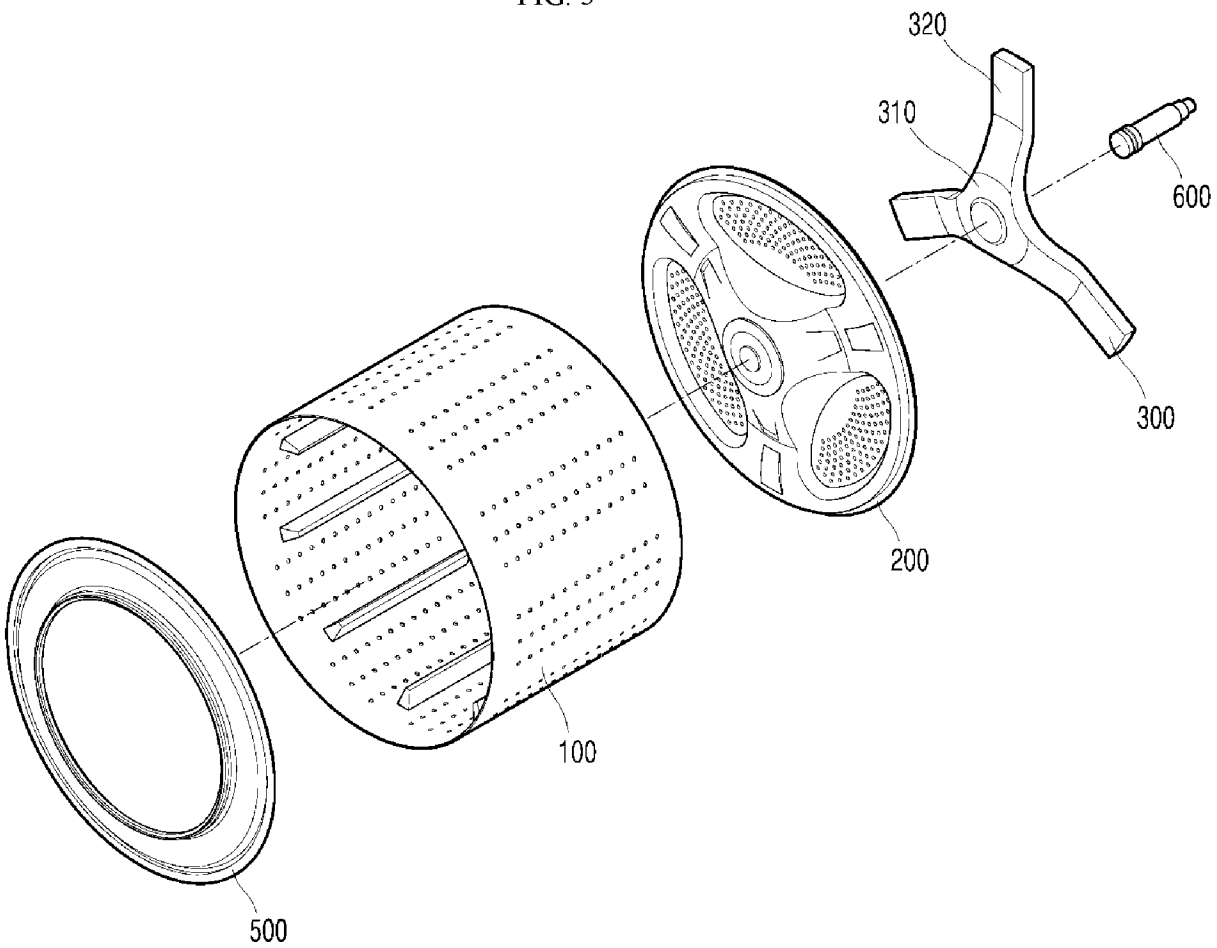
FIG. 3 is an exploded perspective view of main parts of a washing machine according to an embodiment of the present disclosure.

FIG. 1 is an exemplary perspective view of a washing machine according to an embodiment of the present disclosure. FIG. 2 is an exemplary cross-sectional view of a washing machine according to an embodiment of the present disclosure. FIG. 3 is an exploded perspective view of main parts of a washing machine according to an embodiment of the present disclosure.

As illustrated in FIGS. 1 to 3, a washing machine 1000 according to an embodiment of the present disclosure may include a drum 100 and a drum back 200, and may further include a spider 300, a drum cover 500, a shaft 600, a motor 700, a tub 800, and a housing 900.

The housing 900 may be a part that forms the main exterior of the washing machine 1000, and the above components of the washing machine 1000 may be installed within the housing 900. Here, the housing 900 may be subdivided into a base, a cabinet, a top cover, and a cabinet cover.

A laundry entrance through which laundry 10 can be placed into the washing machine 1000 may be formed in one surface of the cabinet cover of the housing 900, and a door 910 for opening and closing the laundry entrance may be installed.

A tub 800 for holding washing water therein may be installed within the housing 900, may be placed on a damper installed in the base of the housing 900, and may be connected to a spring installed in the cabinet as if hung by the spring. As a result, the tub 800 may be supported by the damper and the spring in such a manner that the tub 800 is buffered by the damper and the spring.

The tub 800 may have a structure of a cylinder lying on one side thereof. The drum 100 may be disposed within the tub 800, and the motor 700, which is a driving means for rotating the drum 100, may be installed on a back surface of the tub 800.

The drum 100, as a part for receiving the laundry 10, may be formed, like the tub 800, in a structure of a cylinder lying on one side thereof such that a lower portion of the drum 100 is submerged in washing water within the tub 800, and may be rotatably positioned inside the tub 800.

A plurality of through holes may be formed in a circumferential portion of the drum 100 such that washing water or air flows in through the through holes, and a lifter for lifting and falling the laundry 10 may be mounted in an inner circumferential surface of the circumferential portion of the drum 100.

Meanwhile, the drum 100 may be formed of a single cylindrical member or formed of two members separated into front and back parts. Or, the drum 100 may be formed of three members including a drum cover 500 coupled to a front surface portion of the drum 100 and a drum back 200 coupled to a back surface portion of the drum 100.

Hereinafter, for convenience of description, the description will be made based on the drum 100 formed of three members, and here, the drum 100 may refer to a portion of the drum 100 excluding the drum cover 500 and the drum back 200, that is, to a body portion of the drum 100.

The drum back 200 may be a part coupled to the drum 100 so as to cover the back surface portion of the drum 100, and the drum 100 and the spider 300 may be coupled to each other through the drum back 200. Here, the drum back 200 may be formed in the shape of a disk, and a protruding portion and a recessed portion may be formed in the drum back 200 as needed.

The spider 300 may be a part coupled to the back surface of the drum back 200 so as to transfer rotational force to the drum 100, and may include a shaft fixing portion 310 to which a shaft 600 is coupled and a plurality of leg portions 320 formed to protrude from the shaft fixing portion 310 in a radial direction.

For example, the spider 300 may include the plurality of leg portions 320 radially extending from a rotational axis of the spider 300, and may be formed in a rotationally symmetric shape as a whole about the rotational axis.

In addition, each of the plurality of the leg portions 320 may be coupled to the back surface of the drum back 200 by means of a fastening means such as a bolt.

The shaft 600 may be installed to pass through a back surface of the tub 800, wherein a front end of the shaft 600 may be coupled to the shaft fixing portion 310, and a rear end of the shaft 600 may be coupled to the motor 700. Accordingly, rotational force generated in the motor 700 may be transferred to the spider 300 through the shaft 600, and the drum 100 may be rotated through the drum back 200 coupled to the spider 300.

Figure 4:
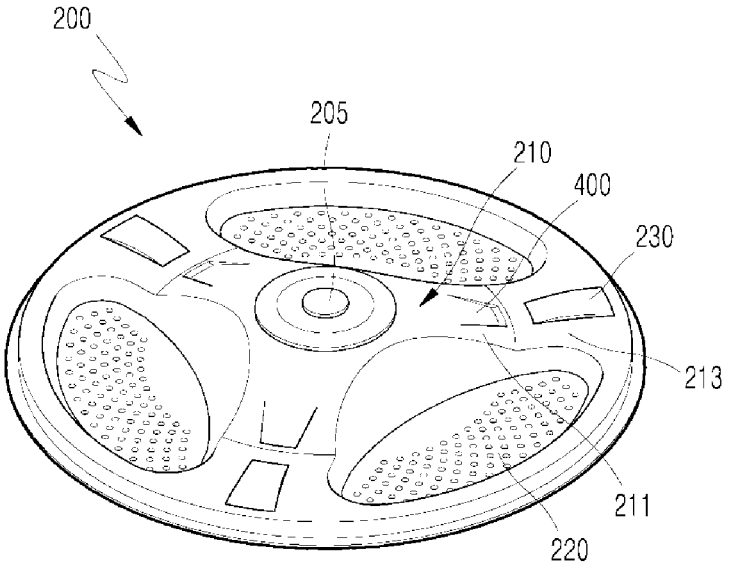
FIG. 4 is a perspective view of a drum back in a washing machine according to an embodiment of the present disclosure.
Figure 5:
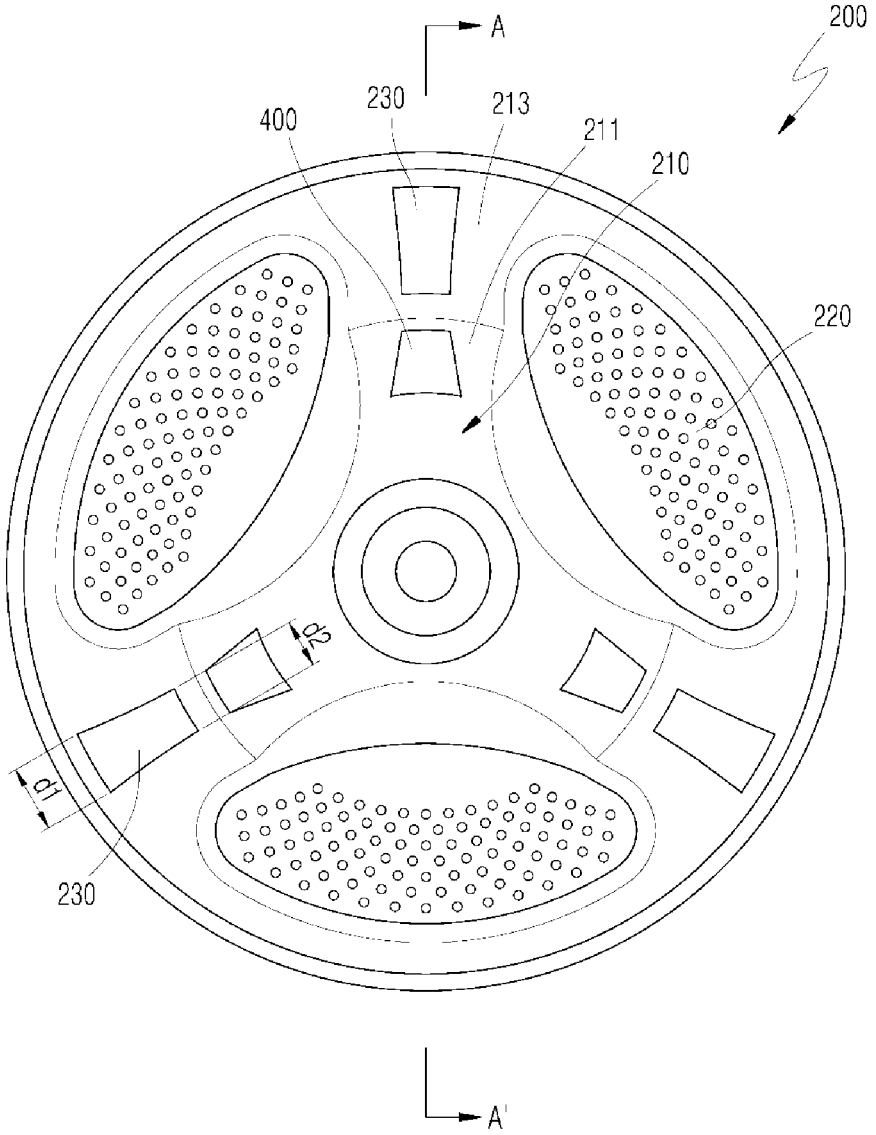
FIG. 5 is a front view of a drum back in a washing machine according to an embodiment of the present disclosure.
Figure 6:
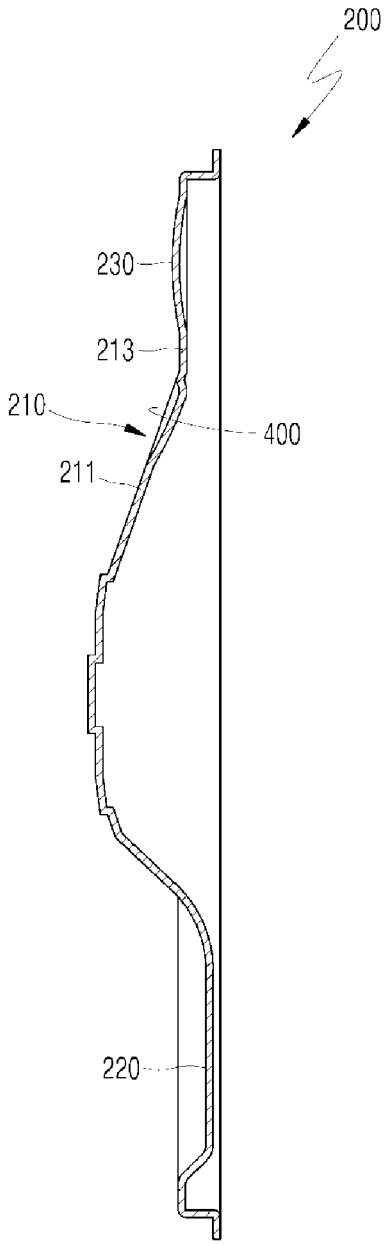
FIG. 6 is a cross-sectional view of FIG. 5 taken along the line from A to A'.

FIG. 4 is a perspective view of a drum back in a washing machine according to an embodiment of the present disclosure. FIG. 5 is a front view of a drum back in a washing machine according to an embodiment of the present disclosure. FIG. 6 is a cross-sectional view of FIG. 5 taken along the line from A to A'.

As illustrated in FIGS. 4 to 6, in the washing machine 1000 according to an embodiment of the present disclosure, the drum back 200 may include a coupling portion 210, a first forming portion 220, and a reinforcement portion 230, and may further include a second forming portion 400.

The coupling portion 210 may be a portion that is formed to protrude in a front direction of the drum 100, and may be formed to be rotationally symmetric about a central shaft 205.

Here, the coupling portion 210 may be formed to protrude in the front direction of the drum 100 at a portion of the drum back 200 to which the spider 300 is coupled so as to correspond to a shape of the spider 300. The coupling portion 210 may be formed to correspond to the shapes of the shaft fixing portion 310 and the leg portions 320 of the spider 300. That is, the protruding degree of the coupling portion 210 in the front direction of the drum 100 may correspond to the angle formed by the shaft fixing portion 310 and the leg portions 320 of the spider 300.

For example, as illustrated in FIG. 3, in the spider 300, the shaft fixing portion 310 may be formed to protrude the most, and three leg portions 320 may be formed to be inclined from the shaft fixing portion 310.

Here, as illustrated in FIGS. 4 to 6, a central area of the coupling portion 210 of the drum back 200 that comes into contact with the shaft fixing member 310 may protrude the most towards a front of the drum 100, and an area of the coupling portion 210 that comes into contact with the leg portions 320 may be formed to protrude from the central area along three inclined surfaces.

The first forming portion 220 may be formed to be recessed in a back direction of the drum 100 at an area of the drum back 200 excluding the coupling portion 210. In addition, in a case where a plurality of first forming portions 220 are formed, the plurality of first forming portions 220 may be rotationally symmetric about the central shaft 205.

In some examples, the first forming portion 220 may be referred to as a first recess portion.

Here, the first forming portions 220 may be portions that are formed to be recessed in the back direction of the drum 100 at areas to which the spider 300 is not coupled, and the first forming portions 220 may thus be formed at areas surrounded by the shaft fixing portion 310 and the leg portions 320 of the spider 300.

That is, the first forming portion 220 may be formed to protrude in a direction opposite to the protruding direction of the coupling portion 210 at an area of the drum back 200 excluding the area where the coupling portion 210 is formed.

For example, as illustrated in FIGS. 4 to 6, the first forming portion 220 may be formed to be recessed at an area surrounded by two adjacent leg portions 320 and a circumferential surface of the drum back 200.

Here, through holes may be formed in the first forming portion 220 such that washing water or air can flow in through the drum back 200.

The reinforcement portion 230 may be a portion that is formed to additionally protrude in the front direction of the drum 200 at an area of the coupling portion 210 that is adjacent to the first forming portion 220, and may reinforce a portion that is vulnerable to defects occurring when said protruding and recessed portions are formed in a molding process.

Specifically, when the protruding portion and the recessed portion are formed in the drum back 200, there is a possibility of defects such as cracks or creases occurring in a boundary between the protruding portion and the recessed portion.

In particular, in a case where the drum 100 is manufactured in a relatively large size, and thus the drum back 200 is also manufactured in a relatively large size, the boundary between the two portions may be even more vulnerable to such a defect.

Accordingly, for reinforcing the vulnerable portions, there is a need to attach an additional reinforcing member to the drum back 200 or form the vulnerable area with a material having a greater rigidity. However, for such a reinforcement, an additional process for reinforcement should be performed aside from the process of manufacturing the drum back 200, which may make the manufacturing of the drum back 200 more complicated.

Therefore, such defects may be more effectively prevented from occurring by forming the reinforcement portion 230, which is formed in a protruding shape in the process of manufacturing the drum back 200 and enables structural reinforcement of the drum back 200.

As described above, in the washing machine 1000 according to this embodiment of the present disclosure, appropriate reinforcement can be made for defects that can occur when the drum back 200 of the washing machine 1000 is manufactured in a relatively large size, since the coupling portion 210 protrudes in the front direction of the drum 100, and the reinforcement portion 230 is formed at an area of the coupling portion 210 that is adjacent to the first forming portion 220 which is recessed in the back direction of the drum 100.

In addition, since the first forming portion 220 which is recessed in the back direction of the drum 100 is formed, and the reinforcement portion 230 is formed at an area of the coupling portion 210 that is adjacent to the first forming portion 220, reinforcement against defects can be made, and at the same time, the drum back 200 can be manufactured in a shape capable of securing a relatively large capacity of the drum 100.

Specifically, the first forming portion 220 may be formed to be recessed in the back direction of the drum 100, and thus the inner space of the drum 100 may be enlarged by the recessed volume of the first forming portion 220. Accordingly, the first forming portion 220 itself may have an effect of increasing the capacity of the drum 100.

Here, if the reinforcement portion 230 is formed in the first forming portion 220, the capacity of the drum 100 may be reduced by the volume of the reinforcement portion 230, which may be a disadvantage in terms of the capacity.

Accordingly, when the reinforcement portion 230 is formed on the coupling portion 210 while the shape of the first forming portion 220 is maintained, the reinforcement against defects may be made, and at the same time, a relatively large capacity of the drum 100 may be secured.

In addition, in the washing machine 1000 according to this embodiment of the present disclosure, as the coupling portion 210 protrudes in the front direction of the drum 100, and the reinforcement portion 230 additionally protrudes from the coupling portion 210, a certain level of washing performance may be secured in the drum 100 coupled to a relatively large-sized drum back 200.

Specifically, one of various factors that determine the washing performance for the laundry 10 in the drum 100 may be a degree of friction between the drum 100 and the laundry 10. That is, more friction between the laundry 10 in the drum 100 and the drum 100 may lead to an improved washing performance.

Accordingly, the degree of friction between the laundry 10 and the drum 100 may be further increased by forming the reinforcement portion 230 to additionally protrude in the front direction of the drum 100. On the contrary, if the reinforcement portion 230 is formed to be recessed in the back direction of the drum 100, it may be possible to make reinforcement against defects, but it may be difficult to secure a certain level of washing performance.

Accordingly, by forming the reinforcement portion 230 to protrude in the front direction of the drum 100, the reinforcement against defects may be made, and at the same time, the washing performance may be improved.

In the washing machine 1000 according to this embodiment of the present disclosure, the coupling portion 210 may include a first surface 211 formed to be inclined from a center of the drum back 200 and a second surface 213 extending from the first surface to the circumferential surface of the drum back 200 to be flush with the circumferential surface, and the reinforcement portion 230 may be formed on the second surface 213.

That is, as illustrated in FIGS. 4 to 6, the first surface 211 may be formed to be inclined in a central area of the drum back 200, and the second surface 213 may be formed to be level in a peripheral area of the drum back 200.

When the drum back 200 is formed in the shape described above, the spider 300 coming into close contact with the back surface of the drum back 200 along an inclined surface of the drum back 200 may be able to more firmly support the drum back 200.

However, when the coupling portion 210 is formed to include the first surface 211 and the second surface 213 for said reason, the second surface 213 may be maintained in an original shape thereof where the second surface 213 neither protrudes nor is recessed.

Accordingly, when a molding process for forming a recess in the first forming portion 220 and forming a protrusion in the first surface 211 is performed, the second surface 213 may be affected by all forces applied from both directions. As a result, the second surface 213 may be most vulnerable to defects.

That is, in the washing machine 1000 according to this embodiment of the present disclosure, the coupling portion 210 may include the first surface 211 formed to be inclined and the second surface 213 extending from the first surface to the circumferential surface of the drum back 200 to be flush with the circumferential surface, and the reinforcement portion 230 may be formed on the second surface 213. Accordingly, a vulnerable portion of the drum back 200, which neither protrudes nor is recessed and is thus affected by the forces in both directions, may be appropriately reinforced.

The second forming portion 400 may be a portion that is formed in the first surface 211 to be recessed in the back direction of the drum 100, and may thus additionally secure the capacity of the drum 100 on the first surface 211 which is relatively resistant to defects. In some examples, the second forming portion 400 may be referred to as a second recess portion.

That is, the inner space of the drum 100 may be additionally enlarged by the recessed volume of the second forming portion 400, and thus the second forming portion 400 may have an effect of additionally increasing the capacity of the drum 100.

That is, in the washing machine 1000 according to this embodiment of the present disclosure, since the second forming portion 400 is formed in the first surface 211 to be recessed in the back direction of the drum 100, a relatively larger capacity of the drum 100 may be secured.

In the washing machine 1000 according to this embodiment, the first forming portion 220 may be a plurality of first forming portions 220 that are separated from each other by the coupling portion 210, and the reinforcement portion 230 may be formed between every two adjacent first forming portions 220.

For example, as illustrated in FIGS. 4 and 5, the first forming portions 220 are formed respectively at three areas of the drum back 200, and the first forming portions may be separated from each other by the coupling portion 210. In addition, reinforcement portions 230 may be formed respectively at areas in the coupling portion 210 between every two adjacent first forming portions 220.

That is, in the washing machine 1000 according to this embodiment, since the reinforcement portions 230 are formed between every two adjacent first forming portions 220 from among the plurality of first forming portions 220, the reinforcement may be uniformly made on the entire plane of the drum back 200.

In the washing machine 1000 according to this embodiment, the reinforcement portion 230 may be formed in such a shape that a cross section thereof includes an arc protruding from the second surface 213.

That is, as illustrated in FIG. 6, the reinforcement portion 230 may be formed in such a shape that a cross section of the reinforcement portion 230 includes an arc where a center of the arc protrudes the most and a portion of the arc away from the center protrudes relatively less, and thus a line from the center to the portion away from the center forms a curve.

Accordingly, even when the reinforcement portion 230 is formed in such a shape that the cross section of the reinforcement portion 230 is relatively large, the reinforcement against defects may be made well in the vulnerable portion by an arch effect.

Meanwhile, the reinforcement portion 230 may be formed in such a manner that the center of the arc is positioned at the most vulnerable area of the drum back 200 by performing a structural analysis or the like.

That is, in the washing machine 1000 according to this embodiment, since the reinforcement portion 230 is formed in such a shape that the cross section thereof includes an arc, a certain degree of rigidity may be secured even when the cross section thereof is relatively large.

In particular, rigidity may be reinforced in a circumferential direction or in a radial direction depending on a direction in which the cross section of the reinforcement portion 230 including an arc is formed.

Here, the reinforcement portion 230 may be formed in such a manner that a protruding plane of the reinforcement portion 230 becomes increasingly wider towards the circumferential surface of the drum back 200.

That is, referring to FIG. 5, the reinforcement portion 230 may be formed in such a shape that a length (d1) of the reinforcement portion 230 at a side of the circumferential surface of the drum back 200 may be greater than a length (d2) at a side of the center of the drum back 200, on a plane of the reinforcement portion 230.

As the drum back 200 is formed in a disk shape as a whole, a surface area covered by the reinforcement portion 230 may become increasingly larger towards the circumferential surface of the drum back 200. Accordingly, it may be preferable to form the reinforcement portion 230 in such a shape that the size of the reinforcement portion 230 becomes increasingly greater towards the circumferential surface of the drum back 200.

That is, in the washing machine 1000 according to this embodiment, since the reinforcement portion 230 has a shape in which the plane of the reinforcement portion 230 becomes increasingly wider towards the circumferential surface of the drum back 200, the effect of reinforcement for a portion of the circumferential surface of the drum back 200 may be further improved.

Figure 7:
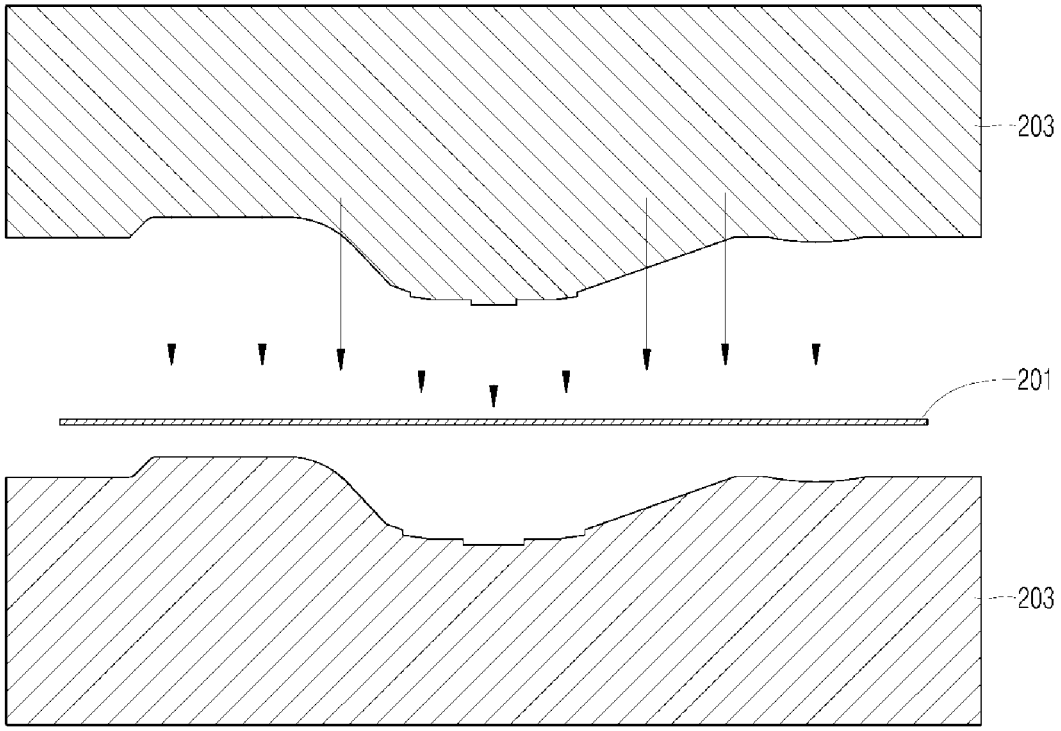
FIGS. 7 and 8 are exemplary views of a process of manufacturing a drum back of a washing machine according to an embodiment of the present disclosure.
Figure 8:
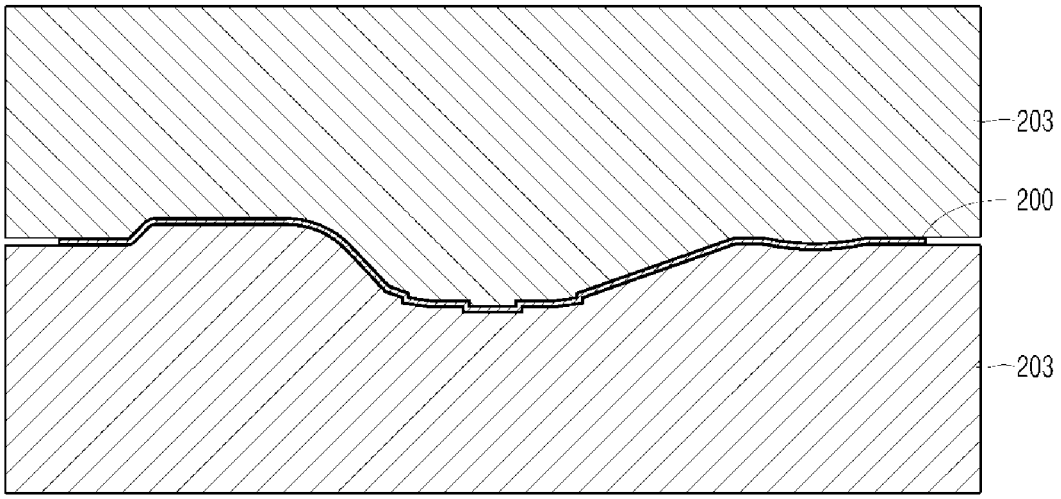

FIGS. 7 and 8 are exemplary views of a process of manufacturing a drum back of a washing machine according to an embodiment of the present disclosure.

As illustrated in FIGS. 7 and 8, in the washing machine 1000 according to this embodiment, the drum back 200 may be formed as a one-piece body by changing a shape of a base sheet 201 having a plate shape. Here, the base sheet 201 refers to a material before being processed into the drum back 200, and may have an entirely flat plate shape.

In particular, the base sheet 201 may be made of a stainless (STS) material such that when the base sheet 201 is pressed, the shape of the base sheet 201 can be changed, and at the same time, the base sheet 201 has a certain degree of rigidity after going through a molding process.

When the drum back 200 is manufactured, if any one of the protruding portion or the recessed portion is separately molded and the molded portion is then joined to the drum back 200, the manufacturing process may be relatively complex, and the joined portion may be vulnerable to cracking or creasing.

Accordingly, considering workability and structural rigidity of the drum back 200, it may be preferable to form the drum back 200 as a one-piece body from a single plate member.

Accordingly, in the washing machine 1000 according to this embodiment, since the drum back 200 is formed as a one-piece body by changing the shape of the plate-shaped base sheet 201, there is no separately joined portion in the drum back 200, and thus a portion vulnerable to structural deformation may be minimized.

Here, the drum back 200 may be formed by pressing the base sheet 201 through a mold 203. That is, when the plate-shaped base sheet 201 is pressed by the mold 203, the base sheet 201 may be protruded or recessed corresponding to a shape of the mold 203, and thus the shape of the base sheet 201 may be changed.

For example, as illustrated in FIGS. 7 and 8, a groove and a protrusion may be respectively formed at areas of the mold 203 that correspond to the protruding portion and the recessed portion of the drum back 200, and the shape of the base sheet 201 may be changed by pressing the base sheet 201 through the mold 203.

That is, in the washing machine 1000 according to this embodiment of the present disclosure, as the drum back 200 is formed by pressing the base sheet 201 through the mold 203, a large quantity of drum backs 200 may be molded in the same size.

Meanwhile, when the drum back 200 is manufactured through the mold 203, the second surface 213 may be a portion that is supported by the mold 203 and thus most vulnerable to creasing. Accordingly, it may be preferable to form the reinforcement portion 230 in the second surface 213.

Furthermore, the drum back 200 may be formed by simultaneously pressing both surfaces of the base sheet 201. That is, two molds 203, which have protruding portions and recessed portions, may be positioned on both surfaces of the base sheet 201, and then the molds 203 may be pressed against each other with the base sheet 201 therebetween so as to come into close contact with the both surfaces of the base sheet 201. By doing so, the drum back 200 may be formed.

If a primary processing is performed for only one surface of the drum back 200, and then a secondary processing is performed for the other surface of the drum back 200, unpredictable defects such as deformation or stress concentration may occur at a portion of the drum back 200 that went through the primary processing when the secondary processing is performed.

In the washing machine 1000 according to this embodiment of the present disclosure, since the drum back 200 is formed by simultaneously pressing the both surfaces of the base sheet 201, the molding process may be relatively simple, and defects that can be caused by a multi-stage compression molding process may be minimized.

Figure 9:
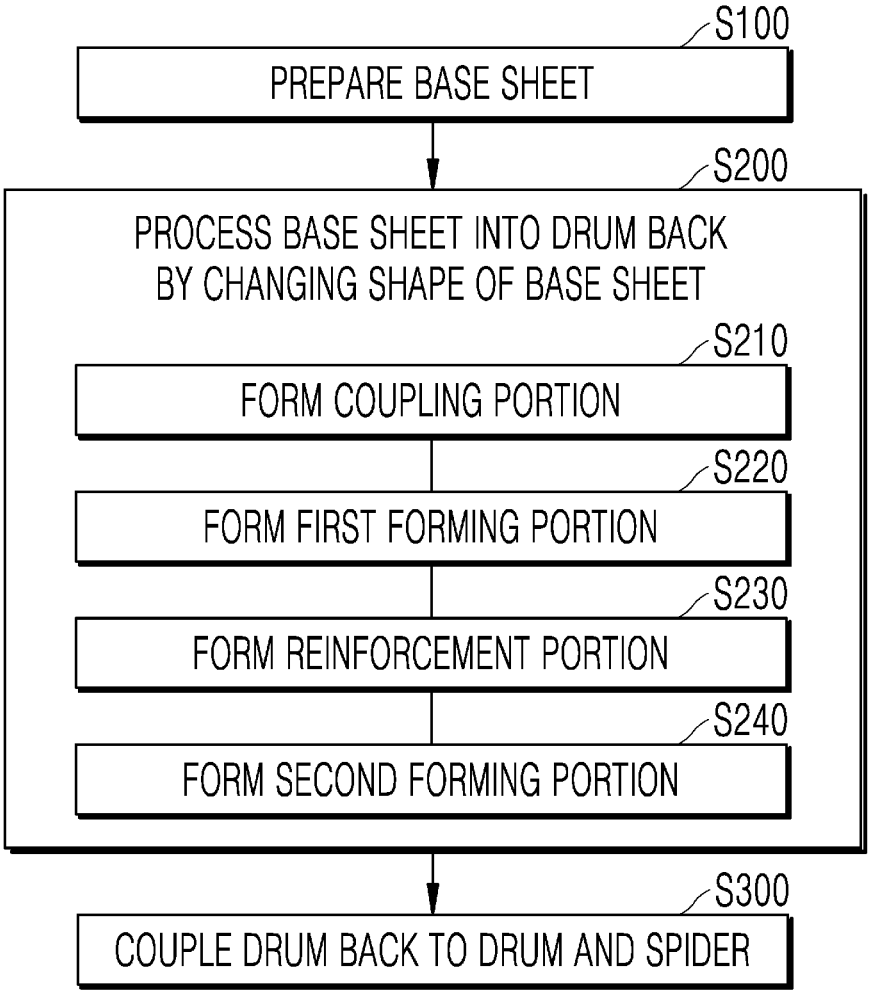
FIG. 9 is a flowchart illustrating a manufacturing method of a washing machine according to an embodiment of the present disclosure.

FIG. 9 is a flowchart illustrating a manufacturing method of a washing machine according to an embodiment of the present disclosure.

The manufacturing method of a washing machine according to an embodiment of the present disclosure will now be described below with reference to FIG. 9. Here, the manufacturing method of a washing machine according to this embodiment may be described based on the main features of the washing machine 1000 described in detail above. Therefore, the description of the manufacturing method of a washing machine will be made together with reference to FIGS. 1 to 8.

Firstly, a base sheet 201 having a plate shape is prepared (S100). Here, the base sheet 201 may be formed as a one-piece body without any separately joined portion.

Next, the drum back 200 is manufactured by changing the shape of the base sheet 201 (S200). Here, the base sheet 201 may be processed in such a shape that a portion thereof protrudes and another portion is recessed, to be formed in the shape of the drum back 200.

Thereafter, the manufactured drum back 200 is coupled to a drum 100 and a spider 300 (S300). That is, the drum back 200 may be coupled to the drum 100 so as to cover a back surface portion of the drum 100, and the drum 100 and the spider 300 may be coupled to each other through the drum back 200.

Here, S200 may include: a step of forming a coupling portion 210 to protrude in a front direction of the drum 100 at a portion of the drum back 200 to which the spider 300 is coupled so as to correspond to a shape of the spider 300 (S210); a step of forming a first forming portion 220 to be recessed in a back direction of the drum 100 at a portion of the drum back 200 to which the spider 300 is not coupled (S220); and a step of forming a reinforcement portion 230 which additionally protrudes in the front direction of the drum 100 at a portion of the coupling portion 210 that is adjacent to the first forming portion 220 (S230), and S200 may further include a step of forming a second forming portion 400 to be recessed in the back direction of the drum 100 at a portion of a first surface 211 of the coupling portion 210.

Accordingly, appropriate reinforcement may be made for defects that can occur in the process of manufacturing the drum back 200 of the washing machine 1000 having a relatively large size. In addition to the reinforcement against defects, the drum back 200 may be manufactured in a shape capable of securing a relatively large capacity of the drum 100. In addition, a certain level of washing performance may be secured for the drum 100 coupled to a relatively large-sized drum back 200.

Meanwhile, the main elements and features of the manufacturing method of a washing machine according to an embodiment of the present disclosure are the same as or similar to those of the washing machine 1000 according to the embodiments of the present disclosure described above. Therefore, detailed description of overlapping contents is omitted.

While specific embodiments of the present disclosure are described and illustrated above, it would be obvious to those skilled in the art that various modifications and variations thereto can be made within the spirit and scope of the present disclosure. Accordingly, such modifications or variations are not to be regarded as a departure from the spirit or scope of the present disclosure, and it is intended that the present disclosure cover the modifications and variations of the present disclosure provided they come within the scope of the appended claims and their equivalents.

What is claimed is:

1. A washing machine comprising:

a drum that defines an opening configured to receive laundry;

a drum back plate that is coupled to the drum and covers a back surface of the drum; and a spider coupled to the drum back plate and configured to transfer rotational force to the drum, wherein the drum back plate comprises:

a coupling portion that protrudes from a first base surface of the drum back plate in a first direction toward the opening and has a shape corresponding to the spider, the spider being coupled to a portion of a second base surface of the drum back plate corresponding to the coupling portion, a first recess portion that is defined at the first base surface and recessed relative to the coupling portion in a second direction opposite to the first direction, the first recess portion being defined at a position facing a side of the spider, and a reinforcement portion that is disposed at the coupling portion and separate from the first recess portion, wherein the coupling portion comprises:

a first surface that radially extends from a center portion of the drum back plate, and a second surface that radially extends from the first surface to a circumferential surface of the drum back plate, the first surface being inclined with respect to the second surface, and wherein the reinforcement portion protrudes from the second surface of the coupling portion in the first direction.

2. The washing machine of claim 1, further comprising a second recess portion defined at the first surface of the coupling portion and recessed in the second direction relative to the first surface of the coupling portion.

3. The washing machine of claim 2, wherein the second recess portion radially extends toward the circumferential surface of the drum back plate, and wherein a width of the second recess portion varies based on a radial position of the second recess portion.

4. The washing machine of claim 3, wherein the width of the second recess portion decreases based on the radial position being closer to the circumferential surface of the drum back plate.

5. The washing machine of claim 1, wherein the first recess portion comprises a plurality of first recess portions partitioned by the coupling portion, and wherein the reinforcement portion is disposed between two of the plurality of first recess portions.

6. The washing machine of claim 1, wherein a cross section of the reinforcement portion has an arc shape that extends from the first base surface of the drum back plate.

7. The washing machine of claim 6, wherein the reinforcement portion radially extends toward a circumferential surface of the drum back plate, and wherein a width of the reinforcement portion varies based on a radial position of the reinforcement portion.

8. The washing machine of claim 7, wherein the width of the reinforcement portion increases based on the radial position being closer to the circumferential surface of the drum back plate.

9. The washing machine of claim 1, wherein the drum back plate is a one-piece body made of a base sheet having a plate shape.

10. The washing machine of claim 9, wherein the base sheet is a press-molded plate.

11. The washing machine of claim 10, wherein the first base surface and the second base surface are simultaneously press-molded surfaces.

12. The washing machine of claim 1, wherein the reinforcement portion is disposed radially outside a central region of the first base surface of the drum back plate, the central region having a first radius from a central shaft of the drum back plate, wherein the coupling portion comprises an inner portion disposed radially inside the first radius and an outer portion disposed radially outside the first radius, the inner portion protruding in the first direction relative to the outer portion, and wherein the reinforcement portion protrudes and extends from a surface of the outer portion of the coupling portion in the first direction.

* * * * *